US005694757A

United States Patent [19]

Smekal et al.

[11] Patent Number: 5,694,757

[45] Date of Patent: Dec. 9, 1997

[54] CONTROL SYSTEM FOR A SPINNING MACHINE

[75] Inventors: Jürgen Smekal, Wendlingen; Mathias Scheufler, Eislingen, both of Germany

[73] Assignee: Zinser Textilmaschinen GmbH, Ebersbach/Fils, Germany

[21] Appl. No.: 688,183

[22] Filed: Jul. 31, 1996

[30] Foreign Application Priority Data

Aug. 1, 1995 [DE] Germany ..... 195 28 204.3

[51] Int. Cl.[6] ..... D01H 7/46; D01H 7/92

[52] U.S. Cl. ..... 57/264; 57/75; 57/98; 57/99; 57/100; 57/136

[58] Field of Search ..... 57/264, 75, 79, 57/99, 100, 119, 136, 93, 98

[56] References Cited

U.S. PATENT DOCUMENTS 5,551,223 9/1996 Nickolay ..... 57/264
5,595,056 1/1997 Scheufler ..... 57/136

FOREIGN PATENT DOCUMENTS 2814989 10/1979 Germany ..... 57/98
37 32 051 4/1989 Germany .
37 32 052 4/1989 Germany .
3017837 11/1991 Germany ..... 57/98

*Primary Examiner*—William Stryjewski
*Attorney, Agent, or Firm*—Herbert Dubno

[57] ABSTRACT

A spinning machine has a third guide eye rail, a third balloon-confining ring rail and a traveller ring rail each of which may be operated by a flexible member from a windless drum and the latter can have an electric motor drive. According to the invention, instead of storing all of the points defining the time course of the movement of the rail, a selected number of points such as starting points for the mean path and amplitude, one or more envelopes, and the amplitude or double amplitude of the oscillation superimposed upon the mean path are determined and a corresponding time course is generated. From the time course at given times determined by the oscillation, the maxima and minima of the path is produced by the evaluation and control unit and used to reverse the motor which raises and lowers the respective rail. By eliminating the need to fully plot and store points representing the entire path, the storage capacity of the computer of the unit can be more limited and control is more reliable and precise.

20 Claims, 3 Drawing Sheets

CONTROL SYSTEM FOR A SPINNING MACHINE

FIELD OF THE INVENTION

Our present invention relates to a control system for a spinning machine and, more particularly, to a control system for at least one vertically-oscillating rail carrying a thread-guide member of a spinning machine and including an electric motor drive for that rail and a control circuit for the electric motor which imposes the oscillating actuation thereon.

BACKGROUND OF THE INVENTION

Spinning machines frequently have a number of rails with respective thread-guide members which must vertically displace with a oscillating movement as the yarn is distributed along the bobbin core of the bobbin on which the yarn is wound. These rails can include a rail for the thread guide on usually disposed along the axis of the spindle and at least which the balloon tends to form below the eye. Below the eye there is normally a balloon limiter which is likewise a member guiding the yarn and is mounted on another rail which customarily is moved up and down in an oscillating motion. The traveler and its ring may likewise be provided on a rail which is vertically oscillated or reciprocated, i.e. the so-called ring rail. Alternatively the spindle itself may be provided on a rail which can be vertically displaced when the ring rail is stationary. All of these rails can be considered to carry thread-guide members which are moved with the ring rail as part of the distribution of the yarn on the bobbin.

In spinning machines, therefore, there is a need for controlling the movement usually of several rails in an absolute and/or relative manner, i.e. for coordination of the relative movements of the rail. In most cases the movement of a rail can be defined by a mean displacement, i.e. a mean height upon which an oscillating component is superimposed. In a ring-spinning machine, for example, the movement of the individual rail for the thread-guide eye, the balloon-confining ring and the traveler ring must be controlled with precision and in dependence upon the spinning laws which apply for the formation of the bobbin.

In DE 37 32 051 A1, a lifter system is provided for a ring rail in which the ring rail and the rails for the balloon-confining ring and/or the thread-guide eye are connected via traction elements with a windless drum. The traction elements pass over deflecting rollers which are provided with a predetermined spacing from one another on a pivotal lifting arm whose pivotal displacement is controlled by a cam to superimpose the oscillatory component of movement on the rails. The mean positions of the rails are determined by the windless drum.

This system has the drawback that, for a change in the relative paths of the mean positions, a mechanical repositioning of the deflecting rollers is required along the arm.

Further, from DE 37 32 052 A1, a lifter system is known in which the individual rails are connected directly via traction elements with respective windless drums. Each windless drum is then separately driven by a motor connected to a control device. This system has the advantage that both oscillating components as well as the mean path of the displacement of each rail can be separately programmed into the respective control device. Mechanical readjustment for changing the mean path is eliminated. DE 37 32 052 A1 does not describe how the programming of the control device is effected. However, since the common control approach is to digitalize the entire movement pattern of each rail and store all of the possible positions in memory, it must be presumed that this system operates with this type of reprogramming. This of course has the drawback that a manual input of all the points in the path of movement of a rail must occur and this is time-consuming and prohibitively costly.

OBJECTS OF THE INVENTION

It is the principal object of the present invention, therefore, to provide a control system for a spinning machine in which the desired time course of the movement of a rail having both a mean path and an oscillatory movement superimposed thereon, which allows a simpler form of control and nevertheless insures that the time course of the rail movement will unfold with the requisite precision.

It is another object of this invention to provide an improved method of operating a control system for a spinning machine whereby drawbacks of earlier systems are avoided.

SUMMARY OF THE INVENTION

These objects and others which will become apparent hereinafter are attained, in accordance with the invention, in a control system of the type described in which an electric motor drive is provided for the rail and is controlled by a control unit. In accordance with the invention, the input to the control units are starting points for the mean path and the amplitude of the time-dependent course of the rail, or starting points for one of the envelope curves and twice the amplitude of this time-dependent course, or starting points for both envelope curves of the time-dependent course. From coordinates of the starting points, a functional dependency of the mean path, the amplitude of oscillation or twice oscillation amplitude or the envelopes are calculated and the control unit is operated to determine the points of path reversal from the functional dependency of the mean path and the amplitude or from the functional dependency of one envelope and twice the amplitude (the double amplitude) or from both envelopes. The control unit is then operated to reverse the operation of the motor at each of the reversal points to bring about the desired time course of the lifting and lowering of the rail with precision.

In particular, the control system of the invention comprises:

an electric motor;

means for coupling the electric motor to the rail for cyclically raising and lowering the rail with a mean path on which a vertical oscillation is superimposed upon actuation of the electric motor; and an evaluation and control unit electrically connected to the electric motor for actuating same, the evaluation and control unit comprising:

means for inputting starting points selectively for a mean path ($<H_{BE}(t)>$) and an amplitude ($\hat{}H_{BE}(t)$) for a time-dependent displacement ($H_{BE}(t)$), the mean path ($<H_{BE}(t)>$) and one envelope ($H_e(t)$; $H'_e(t)$) curve or a value of twice the amplitude (i.e. the double amplitude) of the time-dependent displacement, or both envelope ($H_e(t)$; $H'_e(t)$) curves of the time-dependent displacement;

computer means connected to the means for inputting:

for calculating from coordinates of the starting points of the mean path ($<H_{BE}(t)>$), or of the amplitude ($\hat{}H_{BE}(t)$), or of an envelope curve ($H_e(t)$; $H'_e(t)$) a functional dependency of at least one of the mean path ($<H_{BE}(t)>$), the amplitude ($\hat{}H_{BE}(t)$), the double amplitude, and the envelope curves ($H_e(t)$; $H'_e(t)$), and for calculating from the functional dependency of at least one of the mean path ($<H_{BE}(t)>$), the amplitude ($\hat{}H_{BE}(t)$), the double amplitude, and the envelope curves ($H_e(t)$; $H'_e(t)$, points of reversal of the time-dependent displacement ($H_{BE}(t)$); and means connected to the computer means for actuating the electric motor for displacing the rail with the time-dependent displacement ($H_{BE}(t)$) and with lifting and lowering reversal at the points of reversal.

The invention is based upon the fact that the definition of the desired time course of the movement of a rail can be greatly simplified when at least one envelope for the desired time course is provided with twice the amplitude or both envelope curves are supplied or the mean value and the amplitude are plotted from the reduced number of starting points which must be introduced. Since the coordinate values of these starting points and the functional dependencies can be plotted by the control unit or computer, the later can readily calculate the reversal points which lie along the envelopes so that the motor is reversed at each of these points and the desired time course will be followed with precision in spite of the fact that only the reversal governs the actuation of the motor.

There are several possibilities for so controlling the electric motor drive that the reversal points can occur at predetermined time points.

In one embodiment of the invention, starting from a functional dependency of the mean path of the rail and the amplitude of the oscillating component of the time course of the rail movement, bearing in mind that predetermined times are required for the reversal points, the period of oscillating components can be used to determine the coordinates of the reversal points.

In other words, the period determines the time coordinate while the attainment of the given amplitude from the base line point by the time-dependent mean path forms the other coordinate of each reversal point. The amplitude is added to the corresponding value of the mean value function or subtracted therefrom by the computer.

In a second embodiment, in which the functional dependency of one envelope curve of the desired time course of the movement of the rail is determined, the reversal points are calculated as they initially lie upon this envelope curve utilizing the period of the oscillation as the time component. The remaining reversal point can be calculated by interpolating between each two reversal points along the functionally determined envelope curve and will be of opposite signs so that these points will lie along an envelope curve that need not be calculated and plotted by the computer. The double amplitude can thus be added to the value of the reversal point along the functionally-determined envelope curve (or subtracted therefrom depending upon which envelope is generated) to determine the interpolated points. In both of these cases, a constant amplitude oscillation represents a significant simplification. In that case only a single starting point for the constant amplitude must be supplied and that can be used for calculation of the extremer. A determination of functional dependency of the amplitude or twice the amplitude can be avoided since the amplitude is constant.

In a third embodiment, both envelopes are calculated by the computer and the coordinates of the reversal points are determined by establishing the spacing of the points along each envelope curve based upon the period of the oscillation. In all three cases, the advantage of the system is that many fewer points are required to define the oscillating course of movements of the rail with precision. It is no longer required to program in practically every point of the rail movement for the computer. According to a feature of the invention, the control unit is operated so that between two successive reversal points the speed of the rail is substantially constant.

The required constant speed can be calculated from two neighboring reversal points before the reversal point which is then applicable. The drive can be controlled, moreover, either in response to arrival at the reversal point as determined by positions or by the point in time at which the extreme position is reached.

In another embodiment, the evaluation and control unit, in addition to the starting points for the mean displacement for one of the envelope curves, receives inputs for the magnitude of the speed of the electric motor drive instead of the starting point for the amplitude or double amplitude. The evaluation and control unit then, instead of determining the functional dependency or double amplitude, determines the functional dependency for the speed and controls the electric motor drive so that starting from each reversal point of the drive lying along the envelope curve, the functional speed of the drive is determined and the speed at its given value can be used to determine the reversal points for the time course of the movement of the rail which do not lie upon an envelope curve. The rail is then raised and lowered with these reversal points.

In a preferred embodiment of the invention the evaluation and control unit calculates, from the ordinates of the starting points for the mean path, for the amplitude or double amplitude or for one of the envelope curves, at least one point between two reversal points by interpolation or regression. In the simplest case, a linear interpolation is carried out between two reversal points. Here either the first or second embodiments are used, assuming a constant value for the amplitude or the double amplitude, i.e. the calculation of a functional dependency for the amplitude or double amplitude degenerating in stages.

The input of the starting points or the values for the amplitude or double amplitude and the input for predetermined time points for the reversal points or the period duration can be effected either manually by means of a manual input interfacing with the computer, or directly from the machine controller which can be higher in the control hierarchy.

According to another feature of the invention the starting points or the amplitude or double amplitude can be introduced into the computer by a deep inoperation, i.e. by running the machine through an operation with successive positioning of the rail at each of the reversal points.

According to the invention, the spinning machine can have at least a first and a second rail connected to at least one first electric motor drive and third rail provided with a second electric motor drive. The evaluation and control unit can be supplied with a setpoint ratio of the spacing of the first and third rail of the ratio of the second and third rail, the evaluation and control of the second drive being so controlled that the setpoint ratio remains substantially constant over time.

In a simplified embodiment of the invention, the evaluation and control unit can receive starting points for the mean path of the first and second rail. The evaluation and control unit can then determine the functional dependency for the mean path of the third rail from the starting points or the respective functional dependencies derived therefrom for the mean path of the first and second rails. By inputting a value for starting points for the amplitude of the time-dependent movement of the third rail, the evaluation and control unit can determine the reversal points of the entire time-dependent displacement and the reversal points by suitable choice of the speed of the two electric drives so that the latter can be operated with sufficient precision.

The control system of the invention has been found to be especially advantageous when used in a ring-spinning machine in which the bank or rail for the thread guide eyes and the ring rail is mechanically coupled to be driven and the balloon-confining rail is contrail is controlled in accordance with the invention as described above.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
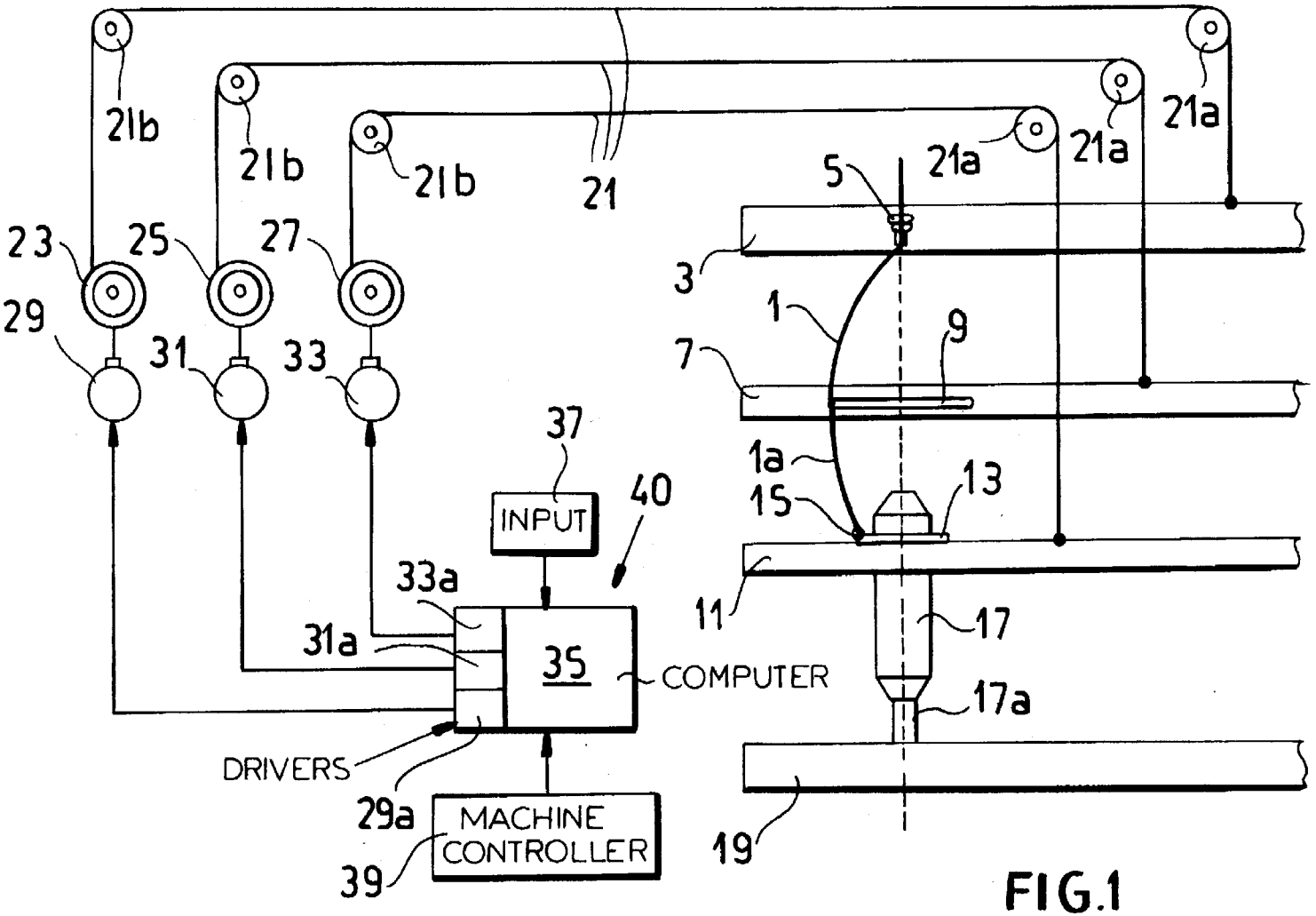
FIG. 1 is a schematic illustration of the important elements of the invention as applied to a ring-spinning machine.

The application of the control system of the invention is described by way of example with respect to a ring-spinning machine of which some components have been shown in FIG. 1 in highly diagrammatic form and solely so that the function of the system will be understood. In FIG. 1, the yarn 1, arriving from a drafting frame, not illustrated, is fed through a third-guide eye 5 on a third guide rail 3 into a balloon 1*a* confined by a balloon constricting or confining ring 9 which, in turn, is mounted upon a respective rail 7. A third rail 11, i.e. the ring rail, carries rings 13 on which travelers 15 orbit the spindle 17*a* carrying the bobbin 17 which is wound up. The bobbins, which may be driven by whorls (not shown) are mounted in a spindle rail and are coaxial with the rings 9 and lie along the axis of the eye 5. The system 5, 9, 17 illustrated in FIG. 1 represents one station of a large number of stations on each side of the machine, each rail being common to a large number of such stations.

While, in this embodiment, the spindle rail 19 is considered to be fixed, i.e. is not raised and lowered, it will be understood that there are cases in which the spindle rail is raised and lowered and the ring rail is stationary. Be that as it may, each of the rails 3, 7 and 11 are vertically movable in depositing the yarn on the bobbin in accordance with the standard yarn-spinning laws. For this purpose, each rail 3, 7, 11 is connected with a downwardly-extending stretch of a flexible tension member 21 passing over rollers 21*a* and 21*b* to a respective windless drum 23, 25, 27. The vertically-movable rails 3, 7, 11, can be provided with respective guides enabling the traction elements 21 to vertically displace these rails.

Each of the windless drums 23, 25, 27 is, in turn, driven by a separate electric motor or electric motor drive 29, 31, 33. The electric motors 29, 31, 33 can be stepping motors or other electronically-controllable and reversible motors. The drivers for these motors are represented at 29*a*, 31*a*, 33*a* and are shown to be coupled to the computer 35 of the evaluation and control represented generally at 40. This system, of course, is advantageous for its simplicity since it enables each of the rails 3, 7, 11 to be precisely positioned without the need for sensors detecting the position.

Of course the windless drums 23, 25, 27 can have other types of electric motor drives and these drives can be optionally connected to the respective rails in other ways. If desired, two of the rails, for example, the rails 3 and 11, can be provided with a single electric motor drive which can be connected by a branching system to the windlesses for these two rails, i.e. a splitting transmission. When different movements of the rails 3, 11 are to be provided but they are to have only a single electric motor drive, the drive of one can be coupled with the drive of the other through a cam or the like. This embodiment of the invention with a reduced number of electric motors has the advantage of lower cost and is used in the case of a ring-spinning machine where the ratio of movements of the ring rail 11 and the guide eye rail 3 are seldom changed. For the balloon ring rail 7, whose movement ratio relative to the other two rails is frequently changed, a separate electric motor drive is used.

As can be seen from FIG. 1, the electric motor 29, 31, 33 are controlled by an evaluation and control unit generally shown at 40 which can include a computer 35. The rails 3, 7, 11 are intended to move up and down with a vertical oscillation component and the evaluation and control unit is so connected to the electric motors 29, 31, 33 via the drivers 29*a*, 31*a*, 33*a* that reversal of the motors is possible at the reversing points described above and below.

The evaluation and control unit 35 can include an input unit 37, for example a keyboard, for the manual inputting of parameters to determine the desired time course of the movement of the rails 3, 7, 11. Superordinated machine control 39, with greater primacy in the control hierarchy, is provided at 39 and can supply the parameters for determining the curves for the movements of the rails.

Figure 2:
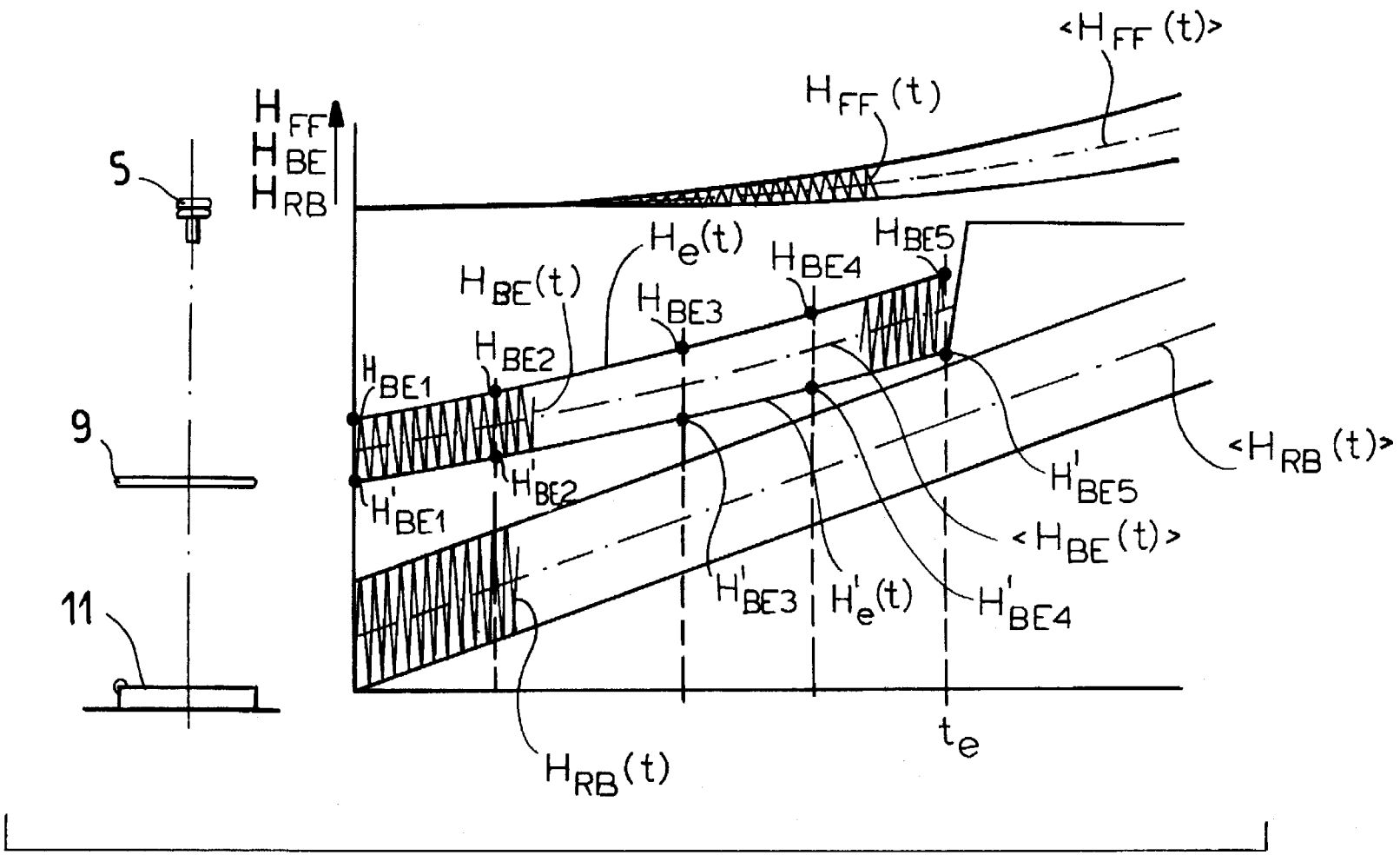
FIG. 2 is a diagram of the time course of the movement of the third guide elements of FIG. 1 in accordance with a first embodiment of the invention.

The parameters for determination of the curves of the evaluation and control unit 35 which represent the motion of the rails, have been illustrated in FIG. 2. From this Figure the time-dependent absolute value of the height of the ring rail ($H_{RB}$), the height of the balloon ring rail ($H_{BE}$) and the height of the rail carrying the thread guides ($H_{FF}$) are shown. The time frame is a complete operation.

As is apparent from FIG. 2, the ring rail 11 which follows a linear mean path $<H_{RB}>$ to form the usual tapered bobbin structure with frustoconical layer of yarn slowly but uniformly rises over the duration of the bobbin winding. On this is superimposed an oscillating component with constant amplitude $\hat{}H_{RB}$. The period or frequency of the oscillating component is usually constant although it theoretically can also be varied.

The time course of the movement of the rail 3 for the thread guides 5 is usually so provided (FIG. 2) that in about the first third of a bobbin winding run, the rail is held at a substantially constant height corresponding to the horizontal portion of the curve $<H_{FF}>$, while toward the end of the run the magnitude of $<H_{FF}>$ progressively increases. Upon this mean height, an oscillating component is superimposed whose magnitude $\hat{}H_{FF}$ progressively increases. Upon this mean height, an oscillating component is superimposed whose magnitude $\hat{}H_{FF}$ also increases. The frequency or period of oscillating component corresponds of course to that of the movement of the ring rail. Both movements are thus phase identical.

Not shown in detail is the spinning process which is not of great significance for the invention which deals with the rail-lifting control system.

The input for determining the time course of the movement of the rail is described in connection with the curve $H_{BE}(t)$ for the movement of the rail 7 of the balloon-confining rail 9. The two other curves $H_{RB}(t)$ and $H_{FF}(t)$ for the movements of the two other rails can be predetermined or can be determined in a similar manner.

According to a first possibility, the input unit 37 supplies the points $H_{BE1}$ to $H_{BE5}$ to the computer of the unit 35, for example, by the use of conventional interpolation or regression processes calculates the curve $H_e(t)$ which represents the upper envelope of the desired time course $H_{BE}(t)$ of the movement of the rail 7.

Other values $\hat{}H_{BE1}$ to $\hat{}H_{BE5}$ for the amplitude or double amplitude of the oscillating component can be fed to the evaluation and control unit 35 by means of the input interface 37, these values being preferably at the same point in time as the values $H_{BE1}$ to $H_{BE5}$. From these amplitude values, the evaluation and control unit can in an analogous manner generate a curve for the time course of the amplitude $\hat{}H_{BE}(t)$.

The motor 31 for the windless drum 25 and thus for the movement of the rail 7 is then controlled by the evaluation and control unit 35 which calculates the maxima and minima of the curve $H_{BE}(T)$ and selects the magnitude of the velocity of the electric motor that these maxima and minima are reached with sufficient precision. The points constitute the points of reversal previously mentioned. The motor velocity is preferably held substantially constant between each two extremas of the path.

The calculation of the maxima can be effected by selecting the coordinates of the point along the curves $H_e(t)$ that coincide with the predetermined time points for the maxima along the upper envelope curve. The calculation of the maxima is based on the precalculated time for the minima and is given by the coordinates of these points along the lower envelope curve $H_e(t)$ and by subtraction of the respective value for the double amplitude of these calculated points. The time-dependent double amplitude value is established from the previously determined functional time dependency of the amplitude $\hat{}H_{BE}(t)$.

Instead of a functional dependency for the time-dependent amplitude $\hat{}H_{BE}(t)$, the evaluation and control circuit and especially the computer thereof can also fully determine the lower envelope $H'_e(t)$ for the double amplitude values $\hat{}H_{BE1}$ to $\hat{}H_{BE5}$ from the related values $H_{BE1}$ to $H_{BE5}$ by subtraction of the double amplitude therefrom.

In an analogous manner, the coordinates of the minima can be determined by inserting the predetermined time points for minima in the functional dependency for the lower envelope.

In another embodiment of the invention, instead of introducing the amplitude or a value for the time-dependency of the amplitude into the unit 35, values for a constant speed or a time-dependent speed which is however substantially constant between two extremas, can be inputted to the computer. The approach to the extreme which does not lie on the upper envelope curve, i.e. the minima, can be effected at a constant speed which is maintained for a predetermined time period at which the minima is reached whereupon the drive is reversed.

It will be self-understood that in this process the determination of the functional dependencies ($H_e(t)$, $H'_e(t)$ or $\hat{}H_{BE}(t)$) can be matched to the number of points which are to be inputted. Instead of a starting point for the upper envelope $H_e(t)$, for example, points for determining the lower envelope $H'_e(t)$ can be inputted and the process modified to determine the maxima in the same way that the determination of the minima was effected as described above.

In a second approach, both the points $H_{BE1}$ to $H_{BE5}$ for determining the upper envelope $H_e(t)$ and also the points $H'_{BE1}$ to $H'_{BE5}$ for determining the lower envelope can be inputted. The process then continues in the manner described to reverse the motor at the respective maxima and minima.

In a third embodiment points for determining the time course of the mean path $\langle H_{BE}(t)\rangle$ can be inputted and the functional dependency determined. In this case, further discrete points for the time course of the amplitude $\hat{}H_{BE}(t)$ can be inputted to the unit 35 and the corresponding functional dependency determined.

The maxima and minima can then be obtained by inputting the time points $t_i$ of the maxima and minima into the corresponding functions $\langle H_{BE}(t_i)\rangle$ and $\hat{}H_{BE}(t_i)$ and the maxima and minima calculated by addition or subtraction of the amplitude values from the coordinates of the mean path at these time points.

As can be seen from FIG. 2, a time point $t_e$ can be inputted into the control unit 35 and which, when reached, so controls the motor 31 of the rail 7 that the rail reaches its upper position. The time point $t_e$ corresponds to the time over which the balloon formed by the yarn is so small that the balloon-confining ring, because of its fixed inner diameter, is ineffective. Up to this point an oscillation of the rail 7 is not necessary and leads only to energy consumption. The upper end position of the rail is chosen for the balloon rings so that they lie in a position in which a collision of the rail 7 with the rails 3 and 11 for the third guides 5 and the rings 11 is excluded.

Figure 3:
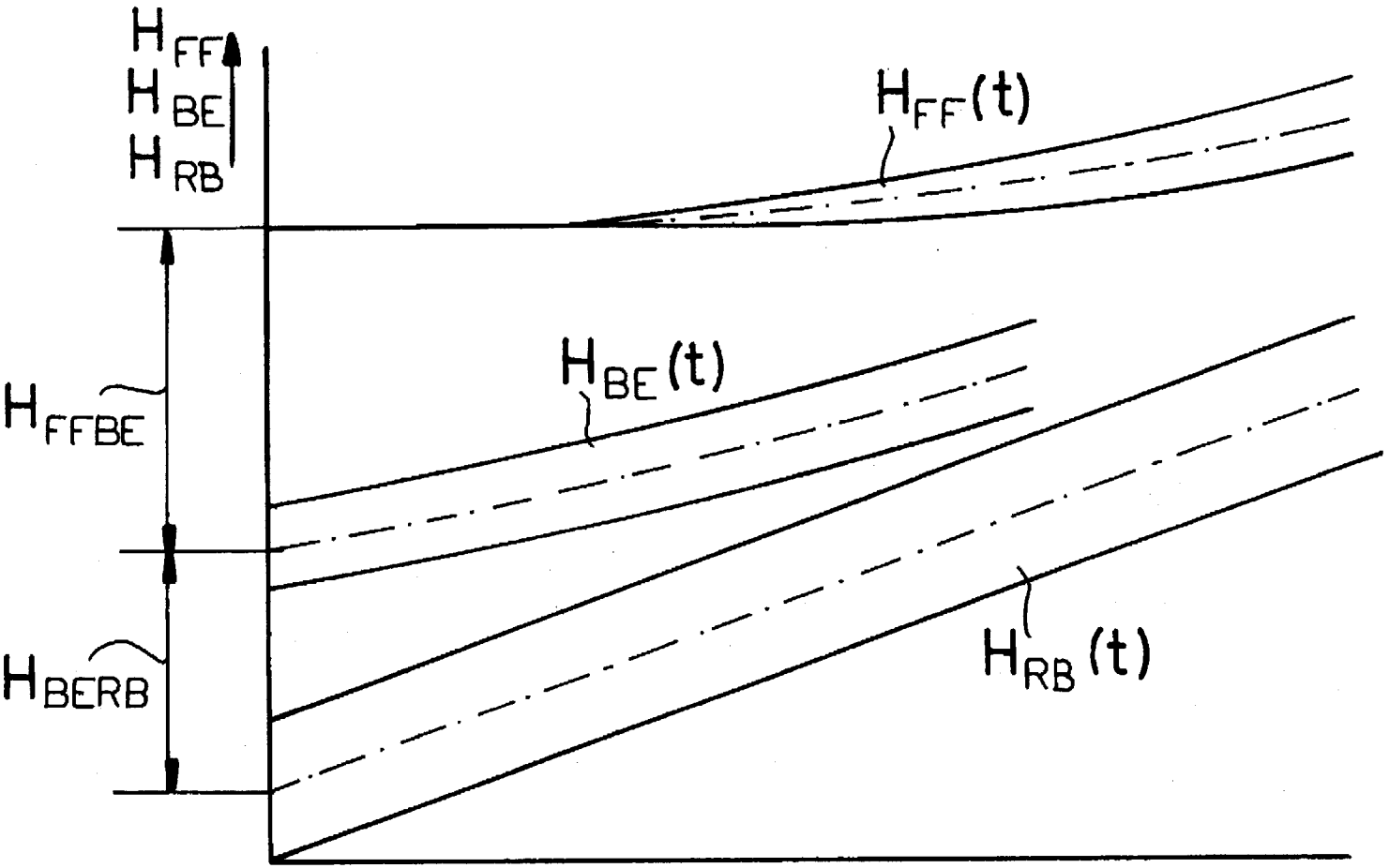
FIG. 3 is a diagram of the time course of the movement of the third guide elements in FIG. 1 according to a further embodiment of the invention.

FIG. 3 shows a further embodiment for determining the time course $H_{BE}(t)$ of the movement of the rail for the balloon-confining rings 9. In this embodiment, the control unit 35 generates a constant ratio V which can be calculated as the quotient between the spacing of rails 3 and 7 and the spacing of the rails 7 and 11.

The control unit 35 operates the motor 35 for the drum 25 so that the ratio V is held constant. The control unit then must know the instantaneous positions of the rails 3 and 11 and the positions of these rails in the next step. This, however, is no problem since the control unit 35 controls both of the electric motors 29 and 33. When the motors 29 and 33 for the rails 3 and 11 are operated at constant speeds by the control unit 35 to reach the predetermined maxima and minima, the motor 31 can be driven to maintain the ratio V constant and provide the maxima and minima for the rail 7. The ratio V thus does not put any great computing load on the frame. The ratio $V=H_{FFBE}/H_{BERB}$ can be selected at 4/3.

In a further feature of the invention, the parameters for determining the time course of the rail 7 of the evaluation and control unit can be established by means of a teach-in process. In this case the ring-spinning machine is operated through a simple cycle manually, preferably by means of the input unit 37 so that the rail 7 is reversed at precise points. By operation of a push button, these points can be fed to the memory of the evaluation and control unit 35 and used as the points described above.

We claim:

1. A control system for a spinning machine having at least one spinning spindle on which yarn is wound and including at least one vertically movable rail carrying a yarn guiding element for yarn supplied to said spindle, said control system comprising:

an electric motor;

means for coupling said electric motor to said rail for cyclically raising and lowering said rail with a mean path on which a vertical oscillation is superimposed upon actuation of said electric motor; and an evaluation and control unit electrically connected to said electric motor for actuating same, said evaluation and control unit comprising:

means for inputting starting points selectively for a mean path ($<H_{BE}(t)>$) and an amplitude ($\hat{}H_{BE}(t)$) for a time-dependent displacement ($H_{BE}(t)$), the mean path ($<H_{BE}(t)>$) and one of the envelope curves ($H_e(t)$; $H'_e(t)$) or the value of twice the amplitude of the time-dependent displacement, one envelope ($H_e(t)$; $H'_e(t)$) curve and a value of twice the amplitude of said time-dependent displacement, or both envelope ($H_e(t)$; $H'_e(t)$) curves of said time-dependent displacement;

computer means connected to said means for inputting:

for calculating from coordinates of the starting points of the mean path ($<H_{BE}(t)>$), or of the amplitude ($\hat{}H_{BE}(t)$), or of an envelope curve ($H_e(t)$; $H'_e(t)$) a functional dependency of at least one of the mean path ($<H_{BE}(t)>$), the amplitude ($\hat{}H_{BE}(t)$), a double amplitude, and the envelope curves ($H_e(t)$; $H'_e(t)$), and for calculating from said functional dependency of at least one of the mean path ($<H_{BE}(t)>$), the amplitude ($\hat{}H_{BE}(t)$), the double amplitude, and the envelope curves ($H_e(t)$; $H'_e(t)$, points of reversal of the time-dependent displacement ($H_{BE}(t)$); and means connected to said computer means for actuating said electric motor for displacing said rail with said time-dependent displacement ($H_{BE}(t)$) and with lifting and lowering reversal at said points of reversal.

2. The control system defined in claim 1 wherein said evaluation and control unit includes means substantially in a time domain of one point of reversal for calculating time and position coordinates of a subsequent point of reversal.

3. The control system defined in claim 1 wherein said evaluation and control unit includes means for maintaining a substantially constant speed of said rail at a magnitude such that each point of reversal is reached with precision at respective points in time determined by said evaluation and control unit.

4. The control system defined in claim 1 wherein said evaluation and control unit includes means for reversing said motor when each point in time corresponding to a point of reversal is reached.

5. The control system defined in claim 1 wherein said evaluation and control unit includes means for determining intermediate points of reversal by interpolation or regression for time segments between two others of said points of reversal with a closed functional dependency.

6. The control system defined in claim 1 wherein said means for inputting includes means for manually feeding data representing said starting points to said unit.

7. The control system defined in claim 1 wherein said means for inputting includes a superordinate machine control system feeding data representing said starting points automatically to said unit.

8. The control system defined in claim 1 wherein said means for inputting includes means for registering said starting points by a teach-in operation of the machine.

9. The control system defined in claim 1 wherein said means for inputting includes means for registering said starting points for said amplitude or double amplitude by a teach-in operation of the machine.

10. The control system defined in claim 1 wherein a first and a second rail of said machine are raised and lowered by said motor and said machine has a third rail which can be raised and lowered by a respective electric motor, said evaluation and control unit generating a setpoint ratio of a spacing between heights of said first and third rails and a spacing between heights of said second and third rails, said evaluation and control unit including means for controlling said electric motor of said third rail so that setpoint ratio is substantially constant over time.

11. The control system defined in claim 10 wherein said starting points of mean paths of said first and second rails are inputted by said inputting means to said unit, said evaluation and control unit deriving from said starting points or functional dependencies developed therefrom, a functional dependency of a mean path of said third rail.

12. The control system defined in claim 11 wherein starting points for a path of said third rail are inputted to said unit and said evaluation and control unit includes means for maintaining a substantially constant speed of said third rail at a magnitude such that each point of reversal is reached with precision at respective points in time determined by said evaluation and control unit.

13. A control system for a spinning machine having at least one spinning spindle on which yarn is wound and including at least one vertically movable rail carrying a yarn guiding element for yarn supplied to said spindle, said control system comprising:

an electric motor;

means for coupling said electric motor to said rail for cyclically raising and lowering said rail with a mean path on which a vertical oscillation is superimposed upon actuation of said electric motor; and an evaluation and control unit electrically connected to said electric motor for actuating same, said evaluation and control unit comprising: means for inputting starting points selectively for a mean path ($<H_{BE}(t)>$) and an amplitude ($\hat{}H_{BE}(t)$) for a time-dependent displacement ($H_{BE}(t)$), the mean path ($<H_{BE}(t)>$) and one of the envelope curves ($H_e(t)$; $H'_e(t)$) or the value of twice the amplitude of the time-dependent displacement, one envelope ($H_e(t)$; $H'_e(t)$) curve and a value of twice the amplitude of said time-dependent displacement, or both envelope ($H_e(t)$; $H'_e(t)$) curves of said time-dependent displacement;

computer means connected to said means for inputting:

for calculating from coordinates of the starting points of the mean path ($<H_{BE}(t)>$), or of the amplitude ($\hat{}H_{BE}(t)$), or of an envelope curve ($H_e(t)$; $H'_e(t)$) a functional dependency of at least one of the mean path ($<H_{BE}(t)>$), the amplitude ($\hat{}H_{BE}(t)$), a double amplitude, and the envelope curves ($H_e(t)$; $H'_e(t)$), and for calculating from said functional dependency of at least one of the mean path ($<H_{BE}(t)>$), and the envelope curves ($H_e(t)$; $H'_e(t)$, and from a magnitude of a speed of the motor, points of reversal of the time-dependent displacement ($H_{BE}(t)$); and means connected to said computer means for actuating said electric motor for displacing said rail with said time-dependent displacement ($H_{BE}(t)$) and with lifting and lowering reversal at said points of reversal at least in part reversing the motor at predetermined points in time at which said points of reversal are reached with said motor operating at substantially constant speed.

14. A ring spinning machine with a control system according to claim 10 wherein said first and second rails are a thread-guide eye rail and a ring rail of the ring spinning machine and said third rail is a rail provided with balloon limiting rings.

15. A method of operating a control system for a spinning machine having at least one spinning spindle on which yarn is wound and including at least one vertically movable rail carrying a yarn guiding element for yarn supplied to said spindle, said control system comprising an electric motor, means for coupling said electric motor to said rail for cyclically raising and lowering said rail with a mean path on which a vertical oscillation is superimposed upon actuation of said electric motor, and an evaluation and control unit electrically connected to said electric motor for actuating same, said method comprising the steps of:

(a) inputting starting points selectively for a mean path ($<H_{BE}(t)>$) and an amplitude ($\hat{}H_{BE}(t)$) for a time-dependent displacement ($H_{BE}(t)$), the mean path ($<H_{BE}(t)>$) and one of the envelope curves ($H_e(t)$; $H'_e(t)$) or the value of twice the amplitude of the time-dependent displacement, one envelope ($H_e(t)$; $H'_e(t)$) curve and a value of twice the amplitude of said time-dependent displacement, or both envelope ($H_e(t)$; $H'_e(t)$) curves of said time-dependent displacement;

(b) automatically calculating from coordinates of the starting points of the mean path ($<H_{BE}(t)>$), or of the amplitude ($\hat{}H_{BE}(t)$), or of an envelope curve ($H_e(t)$; $H'_e(t)$) a functional dependency of at least one of the mean path ($<H_{BE}(t)>$), the amplitude $\hat{}H_{BE}(t)$), a double amplitude, and the envelope curves ($H_e(t)$; $H'_e(t)$);

(c) automatically calculating from said functional dependency of at least one of the mean path ($<H_{BE}(t)>$), the amplitude $\hat{}H_{BE}(t)$), the double amplitude, and the envelope curves ($H_e(t)$; $H'_e(t)$, points of reversal of the time-dependent displacement ($H_{BE}(t)$); and (d) automatically actuating said electric motor for displacing said rail with said time-dependent displacement ($H_{BE}(t)$) and with lifting and lowering reversal at said points of reversal.

16. The method defined in claim 15, wherein in a time domain of one point of reversal, time and position coordinates of a subsequent point of reversal are automatically calculated.

17. The method defined in claim 15 wherein a substantially constant speed of said rail is maintained at a magnitude such that each point of reversal is reached with precision at respective points in time determined by said evaluation and control unit.

18. The method defined in claim 15 wherein said motor is reversed when each point in time corresponding to a point of reversal is reached.

19. The method defined in claim 15 wherein intermediate points of reversal are determined by interpolation or regression for time segments between two others of said points of reversal with a closed functional dependency.

20. The method defined in claim 15 wherein data representing said starting points is fed manually to said unit, a superordinate machine control system feeds data representing said starting points automatically to said unit, or data representing said starting points is registered by a teach-in operation of the machine.

* * * * *